US011350740B2

(12) United States Patent
Leng

(10) Patent No.: US 11,350,740 B2
(45) Date of Patent: Jun. 7, 2022

(54) FOLDABLE TABLE SHELF MECHANISM

(71) Applicant: New-Tec Integration (Xiamen) Co., Ltd., Xiamen (CN)

(72) Inventor: Luhao Leng, Xiamen (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 17/245,295

(22) Filed: Apr. 30, 2021

(65) Prior Publication Data

US 2022/0095787 A1 Mar. 31, 2022

(30) Foreign Application Priority Data

Sep. 29, 2020 (CN) ..... 202022199431.9

(51) Int. Cl.
*A47B 21/02* (2006.01)
*A47B 3/00* (2006.01)

(52) U.S. Cl.
CPC ..... *A47B 21/02* (2013.01); *A47B 3/002* (2013.01)

(58) Field of Classification Search
CPC ..... A47B 83/045; A47B 3/002; A47B 5/00; A47B 5/06; A47F 5/10
USPC ..... 108/99, 38, 93, 95, 92, 100
See application file for complete search history.

(56) References Cited

U.S. PATENT DOCUMENTS 1,204,286 A * 11/1916 Lengquist et al. . A47B 21/0314 108/96
1,322,435 A * 11/1919 Hauptman ..... A47B 3/00 108/99
4,194,452 A * 3/1980 Crowther ..... A47B 9/00 108/138
4,557,200 A * 12/1985 Geschwender ..... A47B 23/001 108/132
6,003,450 A * 12/1999 Bruckner ..... A47B 9/00 108/71
6,561,107 B1 * 5/2003 Wood ..... A47B 3/0812 108/132
7,201,108 B2 * 4/2007 Eusebi ..... A47B 9/00 108/71
8,015,928 B2 * 9/2011 Chen ..... A47B 3/0915 108/35
2002/0023889 A1 * 2/2002 Larbaletier ..... A47F 5/12 211/150
2006/0119237 A1 * 6/2006 Packer ..... A47B 46/005 312/313
2021/0146816 A1 * 5/2021 Schanz ..... A47B 5/06

* cited by examiner

*Primary Examiner* — Jose V Chen

(74) *Attorney, Agent, or Firm* — Cooper Legal Group, LLC

(57) ABSTRACT

The present disclosure discloses a foldable table shelf mechanism. The foldable table shelf mechanism comprises a storage board, a pair of folding frames, and one or more position-limited members. The storage board is configured to be changed to be alternatively in a folded state or in an unfolded state. The one or more position-limited members support the pair of folding frames to enable the storage board to be maintained in an open position when the storage board is in the unfolded state. The storage board parallelly falls frontward and finally abuts a front portion of a top surface of the table during a folding process of the storage board. After being folded, the storage board is convenient for transportation and storage.

13 Claims, 7 Drawing Sheets

FOLDABLE TABLE SHELF MECHANISM

RELATED APPLICATIONS

This application claims priority to Chinese patent application number 202022199431.9, filed on Sep. 29, 2020. Chinese patent application number 202022199431.9 is incorporated herein by reference.

FIELD OF THE DISCLOSURE

The present disclosure relates to a foldable table shelf mechanism.

BACKGROUND OF THE DISCLOSURE

Existing conventional tables comprise a table board and four supporting legs supporting a bottom of the table board. There exists some tables that are equipped with a storage board above the table board to make a storage function of the table more powerful. This type of table is more common on study tables used by students. However, the storage board is generally fixed directly above the table board and does not have a foldable function, which is extremely inconvenient for transportation and storage.

BRIEF SUMMARY OF THE DISCLOSURE

The present disclosure provides a foldable table shelf mechanism to solve the deficiencies in the background.

In order to solve the technical problem, a technical solution of the present disclosure is as follows.

A foldable table shelf mechanism comprises a storage board, a pair of folding frames, and one or more position-limited members. The storage board is disposed above a table, and the pair of folding frames are symmetrically disposed on a left side and a right side of the storage board. Each folding frame of the pair of folding frames comprises a first swing rod and a second swing rod parallelly spaced apart from the first swing rod. An upper end of the first swing rod is pivotally connected to a front portion of a side of the storage board, and a lower end of the first swing rod is pivotally connected to a middle portion of a side of the table. An upper end of the second swing rod is pivotally connected to a rear portion of the side of the storage board, and a lower end of the second swing rod is pivotally connected to a rear portion of the side of the table. The one or more position-limited members are configured to support the second swing rod. When the storage board is in a folding process, the first swing rod and the second swing rod respectively swing frontward about rotation points defined by connecting points at which the first swing rod and the second swing rod are connected to the table and drive the storage board to parallelly fall frontward and to finally abut a front portion of a top surface of the table. When the storage board is in an unfolding process, the first swing rod and the second swing rod respectively swing rearward about the rotation points defined by the connecting points at which the first swing rod and the second swing rod are connected to the table and drive the storage board to parallelly rise rearward above a rear portion of the top surface of the table. When the storage board rises to an open position, the one or more position-limited members support the second swing rod, which is obliquely disposed, to enable the storage board to be maintained in the open position.

Compared with the existing techniques, the technical solution has the following advantages.

The left side and the right side of the storage board are respectively connected to the table by the first swing rod and the second swing rod, so that the first swing rod and the second swing rod can swing synchronously to achieve folding of the storage board. After the storage board is folded, the storage board is supported on the top surface of the table, which does not occupy additional space and is convenient for transportation and storage. After the storage board is unfolded, the one or more position-limited members support the second swing rod, and the structure is simple.

DETAILED DESCRIPTION OF THE EMBODIMENTS

Figure 1:
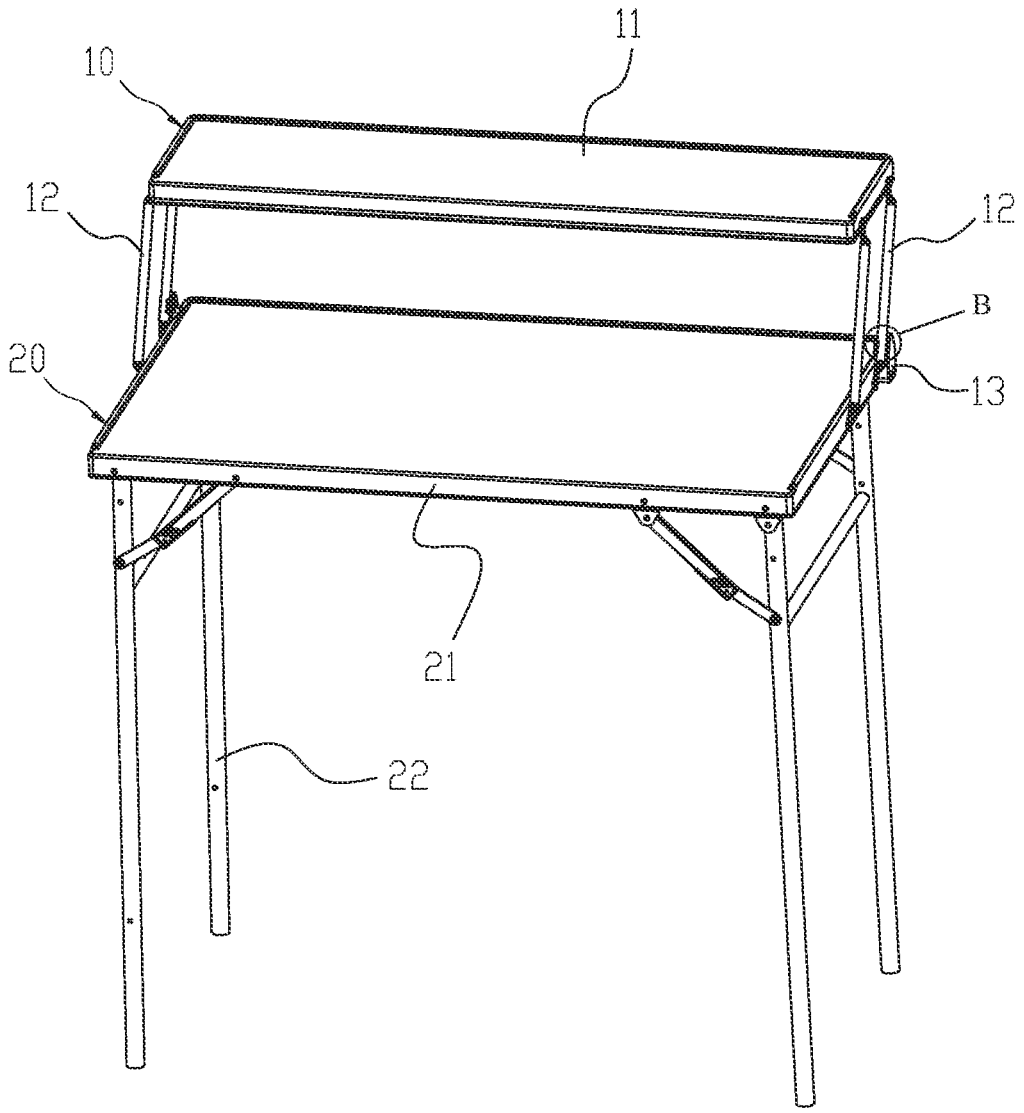
FIG. 1 illustrates a perspective view of a foldable table shelf mechanism when the foldable table shelf mechanism is in an unfolded state.
Figure 2:
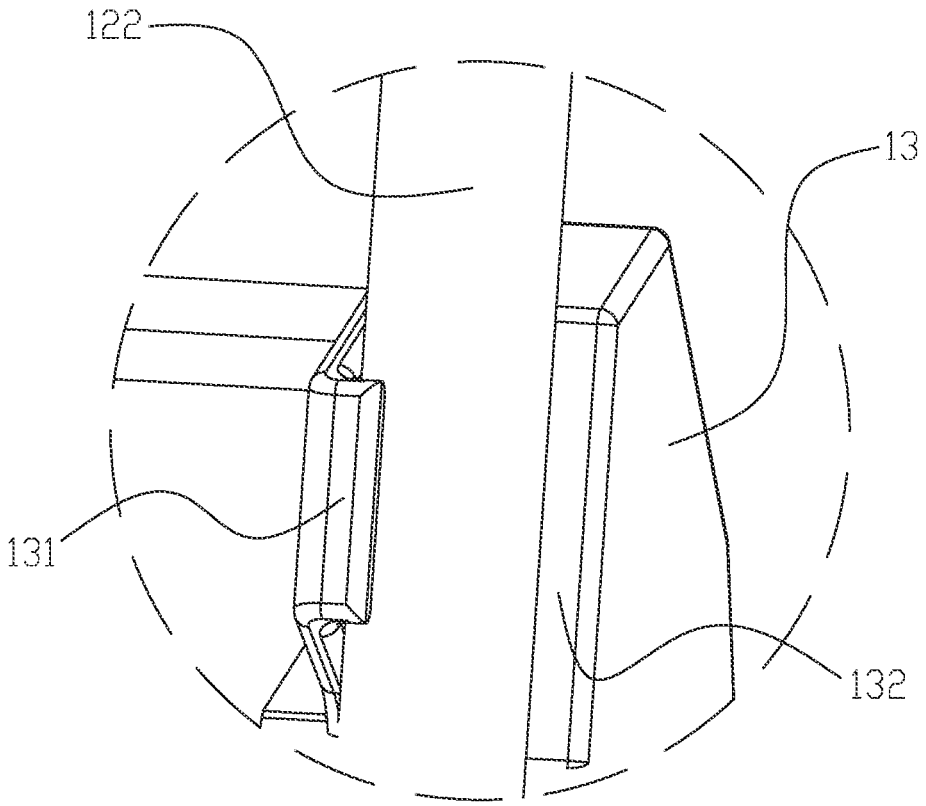
FIG. 2 illustrates an enlarged perspective view of an encircled portion B in FIG. 1.
Figure 3:
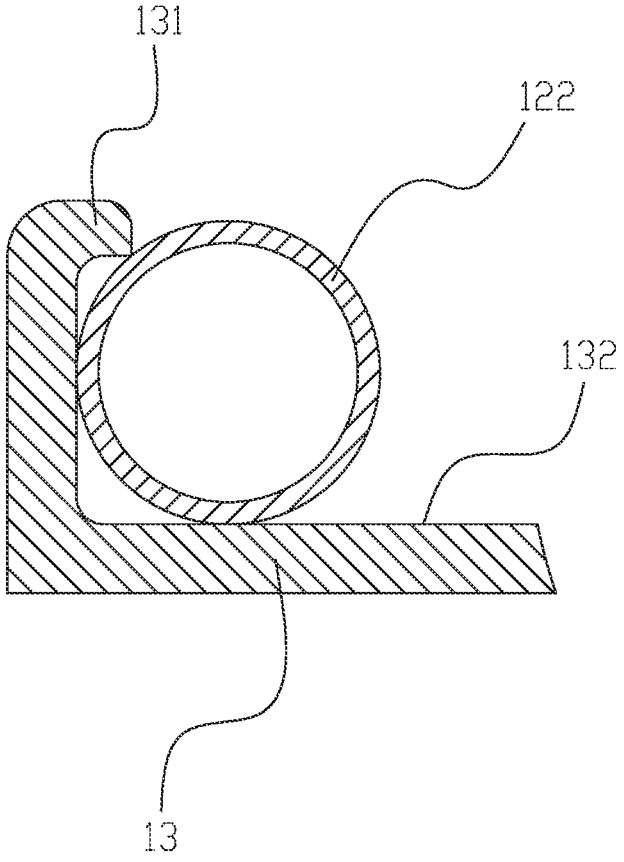
FIG. 3 illustrates a cross-sectional view of a connection between one or more position-limited members and a second swing rod.

The present disclosure will be further described below in combination with the accompanying drawings and embodiments.

Referring to FIGS. 1-7, a foldable table shelf mechanism 10 mounted on and used with a table 20 is provided and has a foldable function. For the convenience of description, a side of the table 20 facing a user is defined as a front side, and a side of the table 20 facing away from the user is defined as a rear side. In this embodiment, any style of table 20 can be used, and the table 20 comprises a table board 21 and four supporting legs 22 for supporting the table board 21.

The foldable table shelf mechanism 10 comprises a storage board 11 disposed above the table 20 and a pair of folding frames 12 symmetrically disposed on a left side and a right side of the storage board 11. Each folding frame 12 of the pair of folding frames 12 comprises a first swing rod 121 and a second swing rod 122 parallelly spaced apart from the first swing rod 121. An upper end of the first swing rod 121 is pivotally connected to a front portion of a side of the storage board 11, and a lower end of the first swing rod 121 is pivotally connected to a middle portion of a side of the table 20 (e.g., a middle portion of a right side and a left side of the table 20). An upper end of the second swing rod 122 is pivotally connected to a rear portion of the side of the storage board 11, and a lower end of the second swing rod 122 is pivotally connected to a rear portion of the side of the table 20 (e.g., a rear portion of the right side and the left side of the table 20). The foldable table shelf mechanism 10 further comprises one or more position-limited members 13 disposed on the table 20. The one or more position-limited members 13 are for supporting the second swing rod 122, and the foldable table shelf mechanism 10 is positionally limited in an open position by the one or more position-limited members 13. Since the second swing rod 122 is parallelly spaced apart from the first swing rod 121, a parallelogram is defined by the first swing rod 121, the second swing rod 122, a connecting line defined between the upper end of the first swing rod 121 and the upper end of the second swing rod 122, and a connecting line defined between the lower end of the first swing rod 121 and the lower end of the second swing rod 122. Thereby, the storage board 11 is driven by the first swing rod 121 and the second swing rod 122 to parallelly rise or fall.

Figure 4:
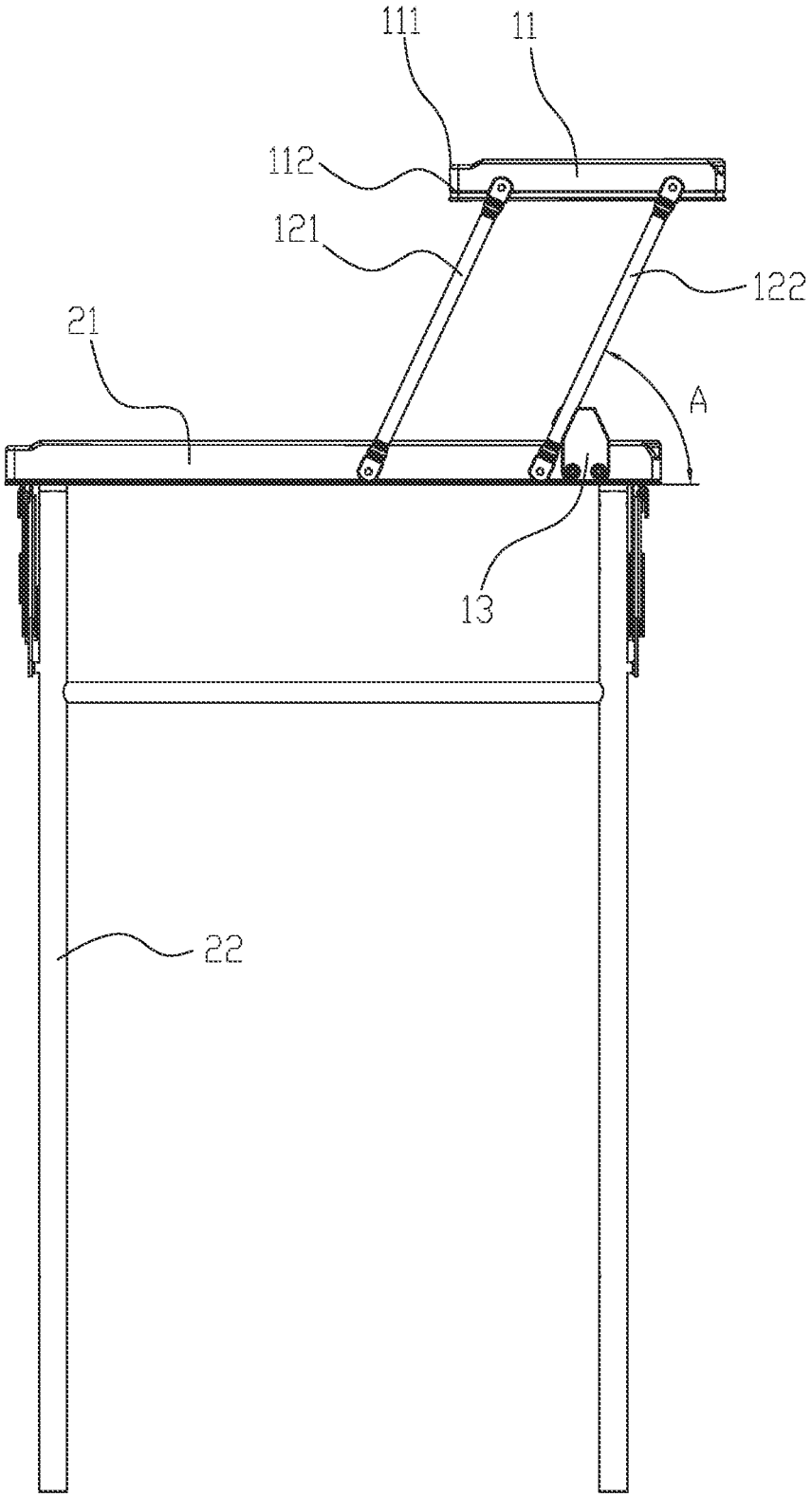
FIG. 4 illustrates a side view of the foldable table shelf mechanism when the foldable table shelf mechanism is in the unfolded state.
Figure 5:
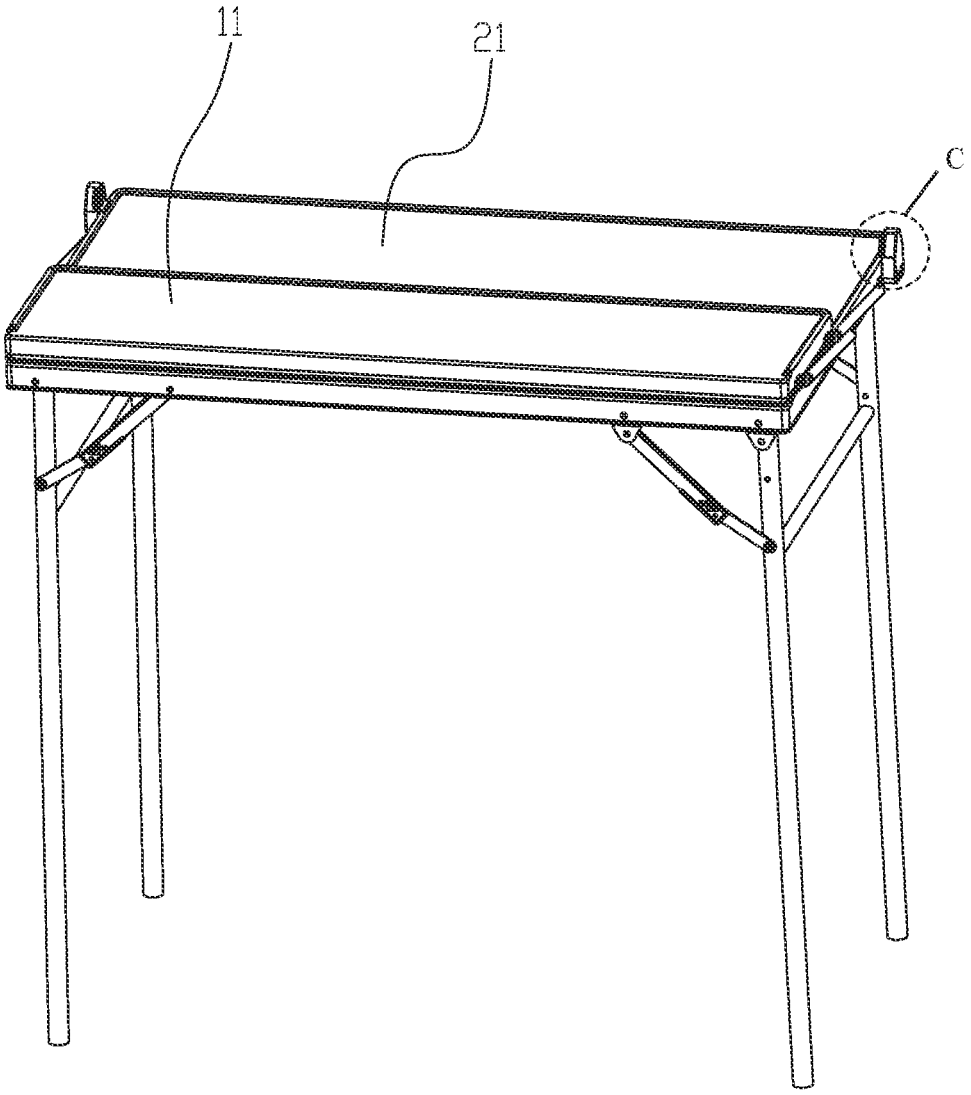
FIG. 5 illustrates a perspective view of the foldable table shelf mechanism when the foldable table shelf mechanism is in a folded state.
Figure 6:
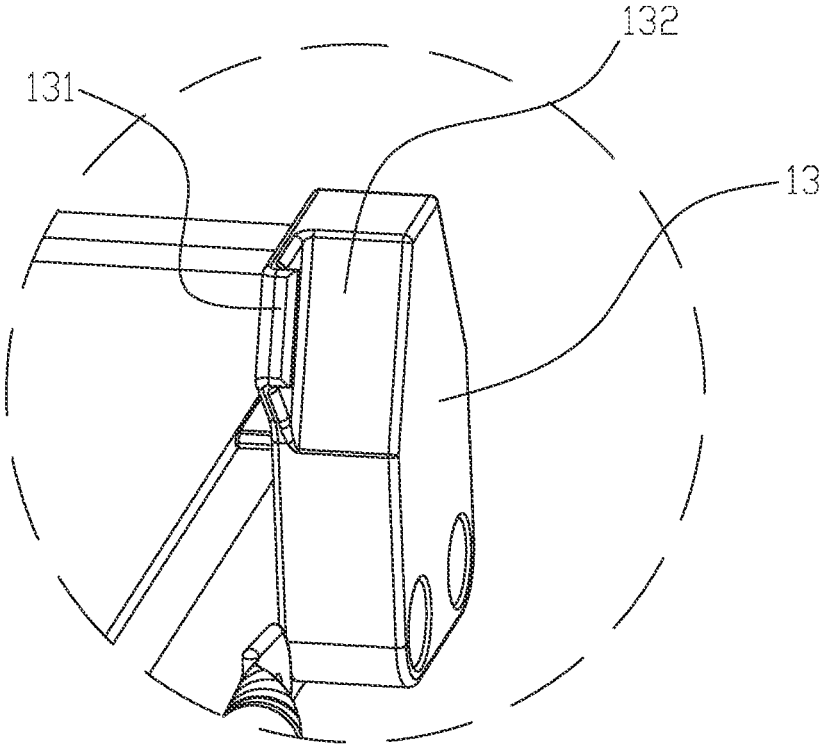
FIG. 6 illustrates an enlarged perspective view of an encircled portion C in FIG. 5.
Figure 7:
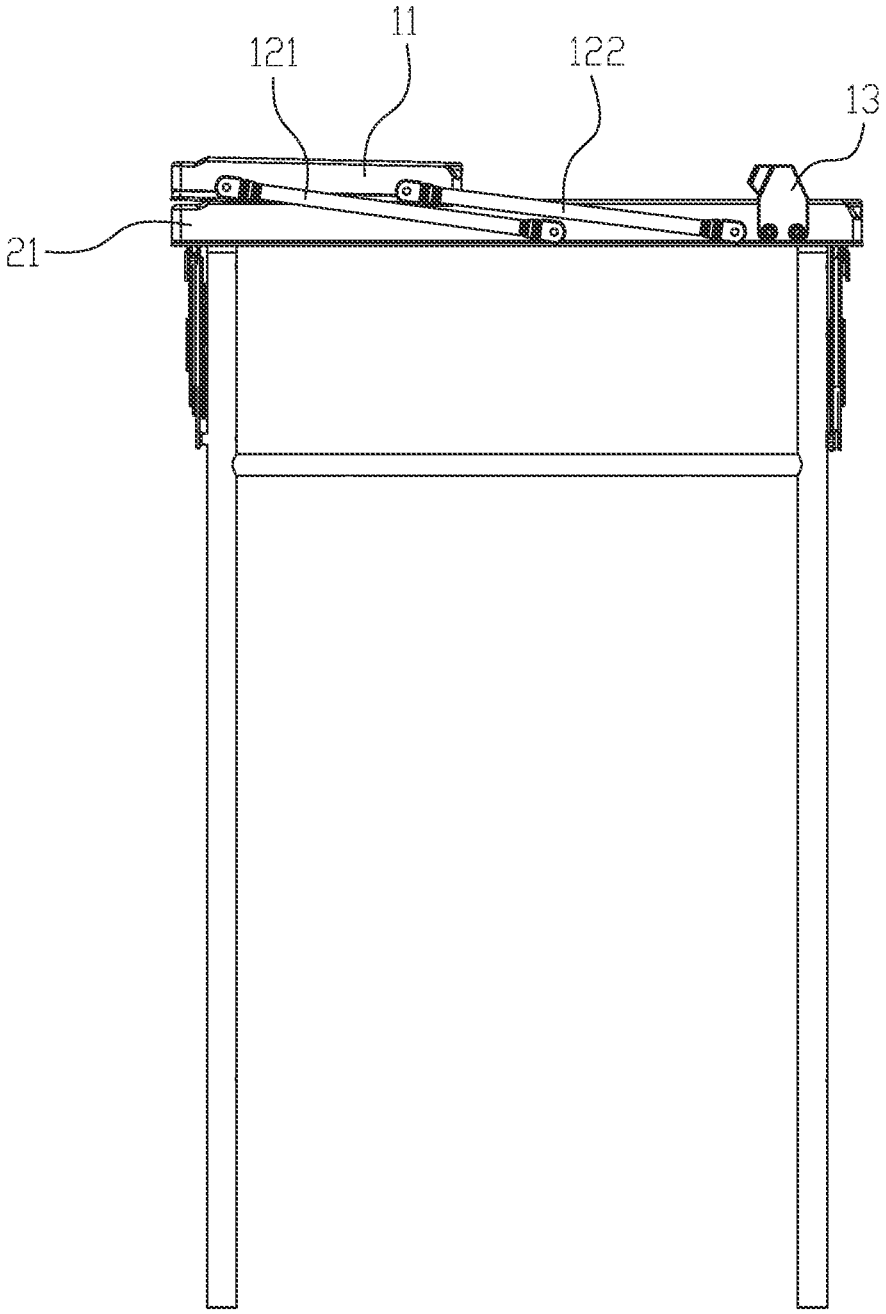
FIG. 7 illustrates a side view of the foldable table shelf mechanism when the foldable table shelf mechanism is in the folded state.

When the storage board 11 is in a folding process, which is illustrated by a change from FIG. 4 to FIG. 5, the first swing rod 121 and the second swing rod 122 respectively swing frontward about rotation points defined by connecting points at which the first swing rod 121 and the second swing rod 122 are connected to the table 20 and drive the storage board 11 to parallelly fall frontward and to finally abut a front portion of a top surface of the table 20.

When the storage board 11 is in an unfolding process, which is illustrated by a change from FIG. 5 to FIG. 4, the first swing rod 121 and the second swing rod 122 respectively swing rearward about the rotation points defined by the connecting points at which the first swing rod 121 and the second swing rod 122 are connected to the table 20 and drive the storage board 11 to parallelly rise rearward and above a rear portion of the top surface of the table 20. When the storage board 11 rises to the open position, the one or more position-limited members 13 support the second swing rod 122, which is obliquely disposed, to enable the storage board 11 to be maintained in the open position.

In a preferred embodiment, the one or more position-limited members 13 are disposed with a reverse snap 131. When the one or more position-limited members 13 support the second swing rod 122 (i.e., in the open position), the reverse snap 131 snaps to the second swing rod 122. Thereby, the second swing rod 122 is stable, and the storage board 11 is not easy to move.

In a preferred embodiment, the reverse snap 131 and the one or more position-limited members 13 are integral with one another (i.e., formed from injection molding). When the storage board 11 is in the folding process, the second swing rod 122 is forcibly pushed rearward to be snapped by the reverse snap 131. Thereby, the reverse snap 131 and the second swing rod 122 are simple in structure and convenient in operation. In some embodiments, the reverse snap 131 can be rotatably connected to the one or more position-limited members 13. When there is no need to limit the second swing rod 122, the reverse snap 131 can rotate to release the second swing rod 122.

In a preferred embodiment, the one or more position-limited members 13 comprise a blocking inclined surface 132 corresponding to the second swing rod 122. When the second swing rod 122 is in the open position, the second swing rod 122 abuts the blocking inclined surface 132. An abutting area between the second swing rod 122 and the blocking inclined surface 132 is larger than the abutting area would be if the blocking inclined surface 132 was not disposed at an incline and is more stable for the second swing rod 122.

In a preferred embodiment, the reverse snap 131 is disposed on a side of the blocking inclined surface 132.

In a preferred embodiment, the one or more position-limited members 13 are two position-limited members 13 symmetrically disposed on the left side and the right side of the table 20 to be configured to respectively support the second swing rod 122 of each of the folding frames 12. A first folding frame 12 of the pair of folding frames 12 disposed on the left side of the table 20 and a second folding frame 12 of the pair of folding frames 12 disposed on the right side of the table are both supported by the two position-limited members 13, and the force applied to the pair of folding frames 12 is more even than if a single position-limited member 13 was disposed on either the left side of the right side of the table 20. Conversely, as long as a strength of the one or more position-limited members 13 is sufficient to meet requirements for the table 20, the one or more position-limited members 13 can be a single position-limited member 13 disposed on a single side of the table 20.

In a preferred embodiment, the one or more position-limited members 13 are disposed on the side of the table 20 and behind the connecting point at which the second swing rod 122 is connected to the table 20. Thereby, the one or more position-limited members 13 will not affect the frontward swing of the second swing rod 122.

In a preferred embodiment, the lower end of the first swing rod 121, the lower end of the second swing rod 122, and the one or more position-limited members 13 are each connected to the side of the table 20.

In a preferred embodiment, when the second swing rod 122 is in the open position, an angle A between the second swing rod 122 and a horizontal plane (e.g., defined by a bottom surface of the table 20) is 45-75 degrees.

In a preferred embodiment, the storage board 11 has a composite structure and comprises a plastic plate 111 and a metal frame 112 embedded in the plastic plate 111, and the first swing rod 121 and the second swing rod 122 are pivotally connected to the metal frame 112. Thereby, the storage board 11 has good strength, which makes the storage board 11 not easily damaged.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A foldable table shelf mechanism, comprising:

a storage board, a pair of folding frames, and one or more position-limited members, wherein:

the storage board is disposed above a table, the pair of folding frames are symmetrically disposed on a left side and a right side of the storage board, each folding frame of the pair of folding frames comprises a first swing rod and a second swing rod parallelly spaced apart from the first swing rod, an upper end of the first swing rod is pivotally connected to a front portion of a side of the storage board, a lower end of the first swing rod is pivotally connected to a middle portion of a side of the table, an upper end of the second swing rod is pivotally connected to a rear portion of the side of the storage board, a lower end of the second swing rod is pivotally connected to a rear portion of the side of the table, the one or more position-limited members are disposed on the table, the one or more position-limited members are configured to support the second swing rod, when the storage board is in a folding process:

the first swing rod and the second swing rod respectively swing frontward about rotation points defined by connecting points at which the first swing rod and the second swing rod are connected to the table and drive the storage board to parallelly fall frontward and to finally abut a front portion of a top surface of the table, and when the storage board is in an unfolding process:

the first swing rod and the second swing rod respectively swing rearward about the rotation points defined by the connecting points at which the first swing rod and the second swing rod are connected to the table and drive the storage board to parallelly rise rearward and above a rear portion of the top surface of the table, and when the storage board rises to an open position, the one or more position-limited members are fastened to the second swing rod and the second swing rod is obliquely disposed with respect to the storage board or the top surface of the table to enable the storage board to be maintained in the open position.

2. The foldable table shelf mechanism according to claim 1, wherein:

the one or more position-limited members are disposed with a reverse snap, and the reverse snap is snapped to the second swing rod when the one or more position-limited members are fastened to the second swing rod.

3. The foldable table shelf mechanism according to claim 2, wherein:

the reverse snap and the one or more position-limited members are integral with one another, and when the storage board is in the folding process, the second swing rod is forcibly pushed frontward, so that the second swing rod is separated from the reverse snap.

4. The foldable table shelf mechanism according to claim 3, wherein:

the one or more position-limited members comprise a blocking inclined surface corresponding to the second swing rod, and when the second swing rod is in the open position, the second swing rod abuts the blocking inclined surface.

5. The foldable table shelf mechanism according to claim 4, wherein the reverse snap is disposed on a side of the blocking inclined surface.

6. The foldable table shelf mechanism according to claim 2, wherein:

the one or more position-limited members comprise a blocking inclined surface corresponding to the second swing rod, and when the second swing rod is in the open position, the second swing rod abuts the blocking inclined surface.

7. The foldable table shelf mechanism according to claim 6, wherein the reverse snap is disposed on a side of the blocking inclined surface.

8. The foldable table shelf mechanism according to claim 1, wherein:

the one or more position-limited members are two position-limited members, and the two position-limited members are symmetrically disposed on a left side and a right side of the table to be configured to respectively support the second swing rod of each folding frame of the pair of folding frames.

9. The foldable table shelf mechanism according to claim 8, wherein each of the two position-limited members is disposed on the side of the table and behind the connecting point at which the second swing rod is connected to the table.

10. The foldable table shelf mechanism according to claim 1, wherein the one or more position-limited members are disposed on the side of the table and behind the connecting point at which the second swing rod is connected to the table.

11. The foldable table shelf mechanism according to claim 1, wherein the lower end of the first swing rod, the lower end of the second swing rod, and the one or more position-limited members are each connected to the side of the table.

12. The foldable table shelf mechanism according to claim 1, wherein when the second swing rod is in the open position, an angle between the second swing rod and a horizontal plane is within 45-75 degrees.

13. The foldable table shelf mechanism according to claim 1, wherein the storage board has a composite structure and comprises a plastic plate and a metal frame embedded in the plastic plate.

* * * * *